US007495213B2

(12) United States Patent
Loboda

(10) Patent No.: US 7,495,213 B2
(45) Date of Patent: Feb. 24, 2009

(54) METHOD AND APPARATUS FOR PROVIDING ION BARRIERS AT THE ENTRANCE AND EXIT ENDS OF A MASS SPECTROMETER

(75) Inventor: Alexandre Loboda, North York (CA)

(73) Assignees: MDS Analytical Technologies, a business unit of MDS Inc., Toronto (CA); Applera Corporation MA (US)

( * ) Notice: Subject to any disclaimer, the term of this patent is extended or adjusted under 35 U.S.C. 154(b) by 180 days.

(21) Appl. No.: 11/689,742

(22) Filed: Mar. 22, 2007

(65) Prior Publication Data

US 2007/0228272 A1 Oct. 4, 2007

Related U.S. Application Data

(60) Provisional application No. 60/788,093, filed on Apr. 3, 2006.

(51) Int. Cl.
*H01J 49/34* (2006.01)
*H01J 49/40* (2006.01)

(52) U.S. Cl. ..... 250/292; 250/282; 250/290

(58) Field of Classification Search ..... 250/290, 250/292

See application file for complete search history.

(56) References Cited

U.S. PATENT DOCUMENTS 6,600,155 B1 7/2003 Andrin, Jr. et al.
6,670,606 B2 12/2003 Verentchikov et al.
6,707,037 B2 * 3/2004 Whitehouse ..... 250/288
6,797,947 B2 9/2004 Russ, IV et al.
6,960,762 B2 11/2005 Kawato et al.
7,145,139 B2 * 12/2006 Syka ..... 250/292
7,227,130 B2 * 6/2007 Hager et al. ..... 250/282

OTHER PUBLICATIONS

Written Opinion for International Application No. PCT/CA2007/000467, Jun. 8, 2007.
International Search Report for International Application No. PCT/CA2007/000467.

* cited by examiner

*Primary Examiner*—David A. Vanore
(74) *Attorney, Agent, or Firm*—Bereskin & Parr

(57) ABSTRACT

There is provided a linear ion trap having an ion guide and a method of operating same. The ion guide has a first end and a second end. The method involves a) providing a first group of ions within the ion guide; b) providing a second group of ions within the ion guide, the second group of ions being opposite in polarity to the first group of ions; c) providing an RF drive voltage to the ion guide to radially confine the first group of ions and the second group of ions in the ion guide; d) providing a gas flow of an inert gas in a first axial direction away from the first end of the ion guide and toward a middle of the ion guide to repel both the first group of ions and the second group of ions from the first end of the ion guide; and, e) providing a trapping region barrier for repelling both the first group of ions and the second group of ions away from the second end of the ion guide. The gas flow in the first axial direction and the trapping region barrier together define a main trapping region for trapping both the first group of ions and the second group of ions.

32 Claims, 8 Drawing Sheets

METHOD AND APPARATUS FOR PROVIDING ION BARRIERS AT THE ENTRANCE AND EXIT ENDS OF A MASS SPECTROMETER

RELATED APPLICATION

This application claims the benefit of U.S. Provisional Application Ser. No. 60/788,093, filed Apr. 3, 2006, the entire content of which is hereby incorporated by reference.

FIELD

The present invention relates generally to mass spectrometry, and more particularly relates to a method and system of providing ion barriers at the entrance end and the exit end of the linear ion trap mass spectrometer.

INTRODUCTION

Typically, linear ion traps store ions using a combination of a radial RF field applied to the rods of an elongated rod set, and axial direct current (DC) fields applied to the entrance end and the exit end of the rod set. Linear ion traps enjoy a number of advantages over three-dimensional ion traps, such as providing very large trapping volumes, as well as the ability to easily transfer stored ion populations to other downstream ion processing units. However, there have been problems with the use of such linear ion traps.

One such problem is that it has not typically been possible to simultaneously store positive ions and negative ions in a linear ion trap. This problem is due to the fact that while a particular axial DC field may provide an effective barrier to an ion of one polarity, the same DC field will accelerate an ion of opposite polarity out of the linear ion trap. Thus, linear ion traps relying on DC barrier fields have not typically been used to simultaneously store ions of opposite polarities.

Accordingly, there remains a need for linear ion trap systems and methods of operating linear ion traps that allow ions of opposite polarity to be trapped simultaneously.

SUMMARY

In accordance with an aspect of a first embodiment of the invention, there is provided a method of operating a linear ion trap having an ion guide. The ion guide has a first end and a second end. The method comprises: a)

providing a first group of ions within the ion guide; b) providing a second group of ions within the ion guide, the second group of ions being opposite in polarity to the first group of ions; c) providing an RF drive voltage to the ion guide to radially confine the first group of ions and the second group of ions in the ion guide; d) providing a gas flow of an inert gas in a first axial direction away from the first end of the ion guide and toward a middle of the ion guide to repel both the first group of ions and the second group of ions from the first end of the ion guide; and, e) providing a trapping region barrier for repelling both the first group of ions and the second group of ions away from the second end of the ion guide; wherein the gas flow in the first axial direction and the trapping region barrier together define a main trapping region for trapping both the first group of ions and the second group of ions.

In accordance with a second embodiment of the invention, there is provided a linear ion trap comprising: an ion guide, the ion guide having a first end and a second end; an RF drive voltage power supply connected to the ion guide for providing an RF drive voltage to the ion guide to radially confine ions of both polarities within the ion guide; a first gas source for providing a first gas flow of an inert gas within the ion guide in a first axial direction away from the first end of the ion guide and toward a middle of the ion guide, the first gas flow having sufficient density and velocity to repel the ions of both polarities away from the first end and toward the second end; and, a trapping region barrier at the second end for repelling ions of both polarities away from the second end of the ion guide. The gas flow in the first axial direction and the trapping region barrier together define a main trapping region for trapping ions of both polarities.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in anyway.

DESCRIPTION OF VARIOUS EMBODIMENTS

Figure 1:
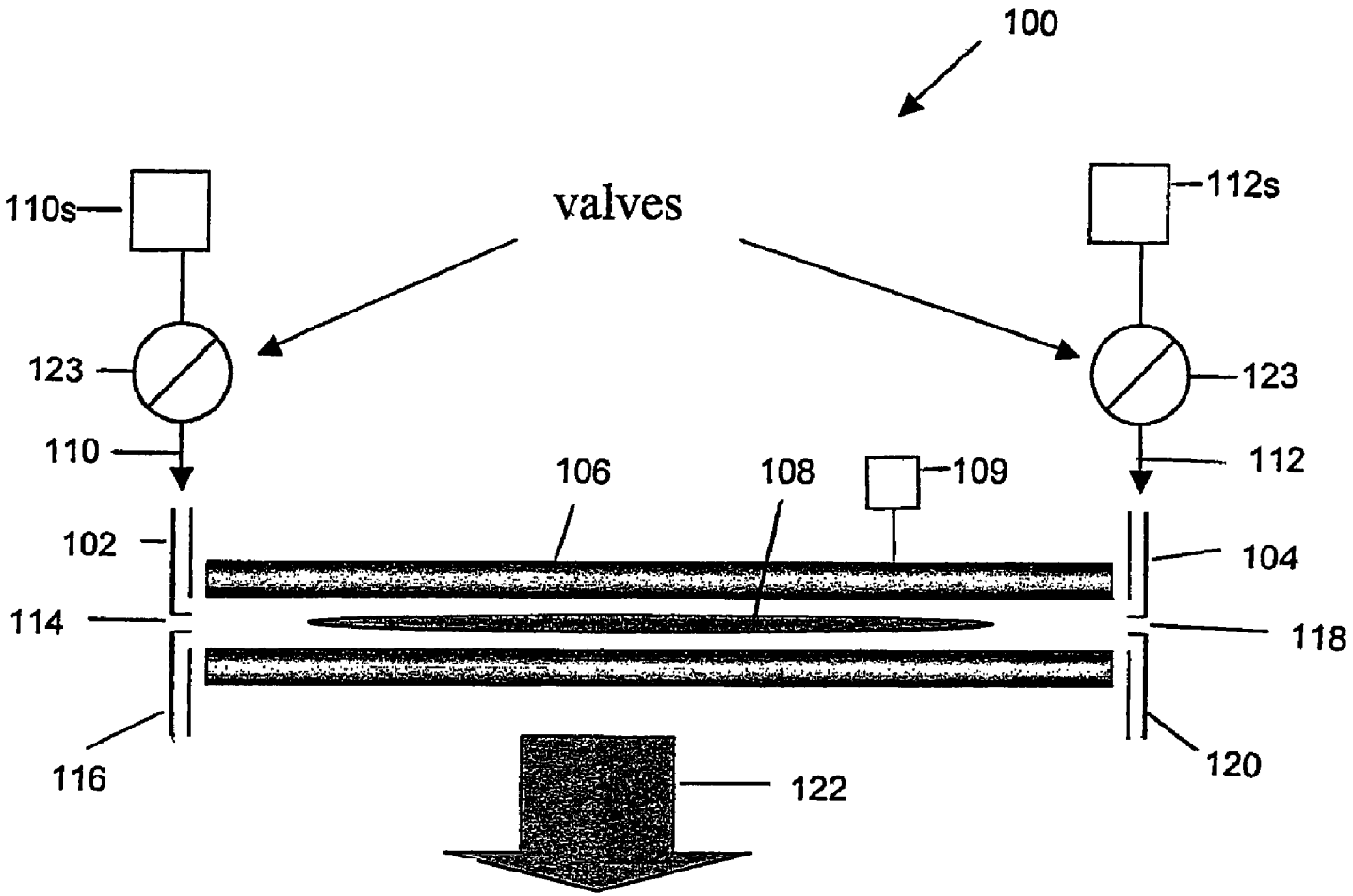
FIG. 1, in a schematic diagram, illustrates a linear ion trap mass spectrometer in which oppositely oriented gas flows are provided at each end of the linear ion trap in accordance with an embodiment of the invention.

Referring to FIG. 1, there is illustrated in a schematic diagram a linear ion trap mass spectrometer 100 in accordance with an embodiment of the present invention. The linear ion trap mass spectrometer 100 comprises a first end 102 and a second end 104, with a rod set 106 extending between the first end 102 and the second end 104. Ions 108 can be inserted into an interior space inside the rod set 106, where the ions 108 can be radially contained by RF drive voltage power supply 109 providing a radial RF field to the rod set 106. In accordance with aspects of the invention, ions 108 may include a first group of ions, and a second group of ions, the second group of ions being of opposite polarity to the first group of ions. To axially contain the ions 108 within the rod set 106, a first inert gas flow 110 is provided at the first end 102 of the rod set 106, while a second inert gas flow 112 is provided at the second end 104 of the rod set 106. As shown, the first and second gas flows are supplied from first and second gas sources 110*s* and 112*s* respectively. Alternatively, of course, a single source may provide both the first and second gas flows 110 and 112. The first inert gas in the first gas flow may be the same, or different, from the second inert gas in the second inert gas flow.

The first gas flow 110 is provided via a first end aperture 114 in a first end plate 116, such that the first gas flow 110 flows within the rod set 106 in a substantially axial direction from the first end 102 toward the middle of the rod set 106. Similarly, the second gas flow 112 is provided to the interior of the rod set 106 via a second end aperture 118 in a second end plate 120 such that the second gas flow 112 flows in a substantially axial direction from the second end 104 toward the middle of the rod set 106. Both the first gas flow 110 and the second gas flow 112 are controlled by gas flow control valves 123.

The first gas flow 110 and the second gas flow 112 are pulled toward the middle of the rod set by a pump 122. At pump 122, both the first inert gas and the second inert gas are pumped out of the rod set 106. The radial RF field provided to the rod set 106 impedes ions from being pumped out of the trap by pump 122. In addition, the ions are axially confined within the rod set 106 by the collisional dampening effects of the gas flows 110 and 112 on the ions' axial velocities towards the nearer of the two ends 102, 104.

Rates of the first gas flow 110 and the second gas flow 112 sufficient to contain the ions 108 may be determined in several ways, one of which is through experimentation. In the case of experimentation, by placing ion detectors at the ends 102 and 104 of the linear ion trap mass spectrometer 100, the rate at which ions 108 escape from the trap based on particular gas flow rates can be determined. If the gas flow rate is effective, then the rate of escape of ions will be significantly lower with the gas flow turned on, as compared to when the gas flow is turned off. A rate of gas flow may also be determined theoretically. For example, a rough estimate of the most efficient flow rate may be achieved by setting the minimum flow rate such that the integral of the pressure of the gas along the axis over the barrier region (the region from where the gas was introduced to where the gas is pumped out) is 1 mTorr*cm (see, for example, U.S. Pat. No. 4,963,736, the contents of which are hereby incorporated by reference). Alternatively, the requirements of the gas flow may be obtained by satisfying the following equation:

$$L*v(g) \geqq D,$$

where L is the length of the barrier region, v(g) is the velocity of the gas in the barrier region, and D is the diffusion coefficient for the ions of interest.

Optionally, in some embodiments, instead of gas flow 110 being provided by gas source 110*s*, gas flow 110 may result from the higher pressure in the previous stage of a mass spectrometer. This higher pressure in the previous stage of the mass spectrometer could, in turn, be a result of the design of the sampling interface or created on purpose using a flow of gas.

Figure 2:
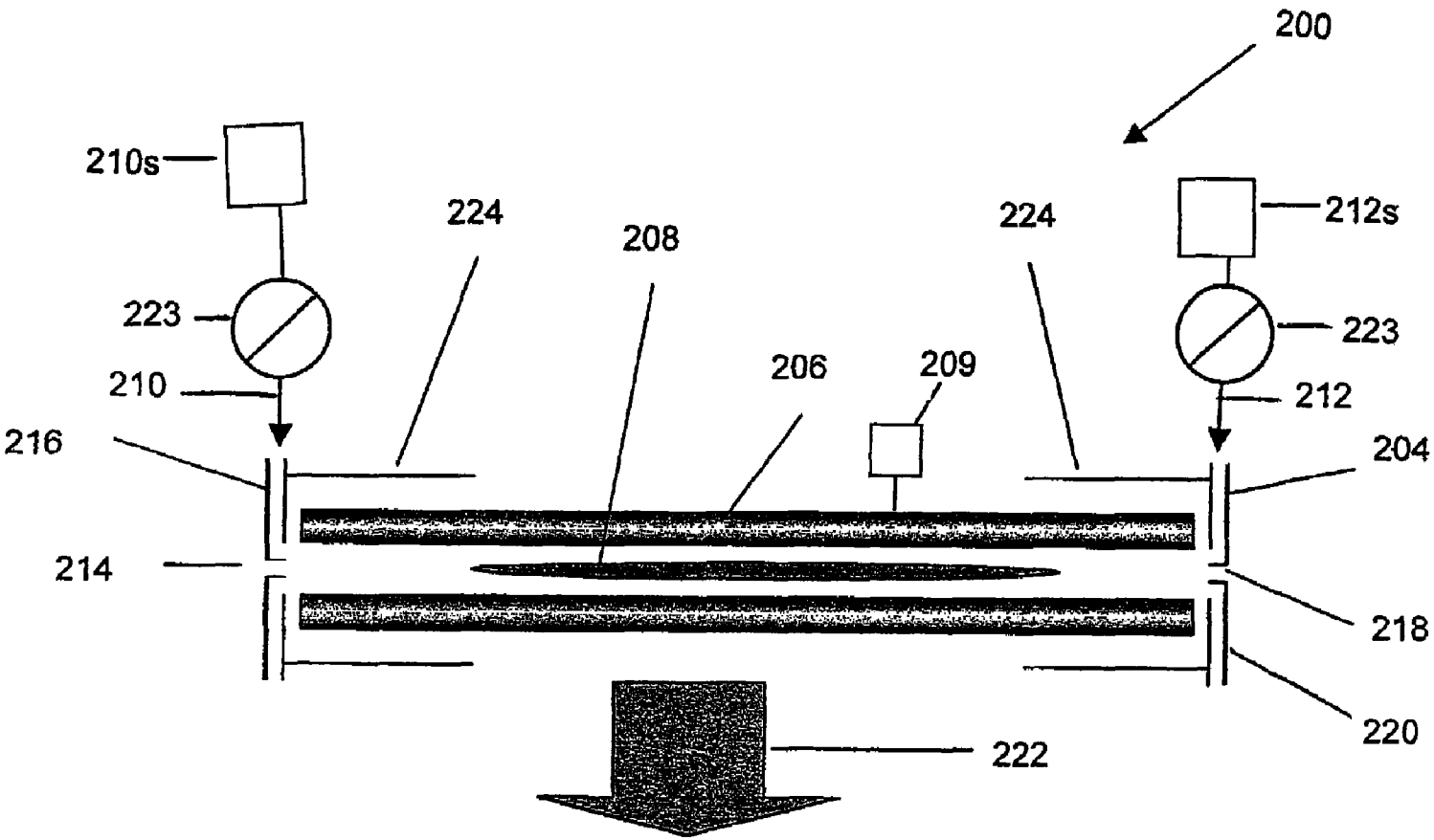
FIG. 2, in a schematic diagram, illustrates a linear ion trap mass spectrometer in which oppositely oriented gas flows are provided at each end of the linear ion trap, which gas flows are channeled by confining sleeves in accordance with a further embodiment of the invention.

Referring to FIG. 2, there is illustrated in a schematic diagram, a linear ion trap mass spectrometer 200 in accordance with a second embodiment of the invention. For clarity, the same reference numerals together with 100 added, are used to designate elements of the linear ion trap mass spectrometer system 200 analogous to elements of the linear ion trap mass spectrometer system 100 of FIG. 1. For brevity, some of the description of FIG. 1 will not be repeated with respect to FIG. 2.

Similar to the linear ion trap mass spectrometer 100 of FIG. 1, in the linear ion trap mass spectrometer 200 of FIG. 2 a first gas flow 210 is provided via a first end aperture 214 in a first end plate 216, such that the first gas flow 210 flows within the rod set 206 in a substantially axial direction from a first end 202 toward the middle of the rod set 206. Similarly, a second gas flow 212 is provided to the interior of the rod set 206 via a second end aperture 218 in a second end plate 220 such that the second gas flow 212 flows in a substantially axial direction from the second end 204 toward the middle of the rod set 206.

To channel the first gas flow 210 and second gas flow 212 in opposite axial directions, sleeves 224 are provided at each end of the rod set 206. In some embodiments, the sleeves are cylindrical; having a radius greater than the radius of the rod set 206 (the distance from the central longitudinal axis of the rod set to the midpoint of the rods). These sleeves 224 surround the rod set 206 at the end apertures 214 and 218, and extend at least part of the way toward the middle of the rod set 206. Similar to the rod set 106 of FIG. 1, ions are confined to the rod set 206 radially by the application of a radial RF field to the rod set 206, and longitudinally by first gas flow 210 and second gas flow 212, the effectiveness of which is increased by confining sleeves 224. In the embodiment of FIG. 2, the confining sleeves 224 are not attached to the first end plate 216 and the second end plate 220. Optionally, in other embodiments, the confining sleeves may be attached, or extend all the way, to the end plates 216 and 220. The flow of gas can also be confined by using inserts placed to close the gap between adjacent rods. The action of the inserts will be similar to the action of the gas confining sleeves such that they aid in containing the gas flow.

Figure 3:
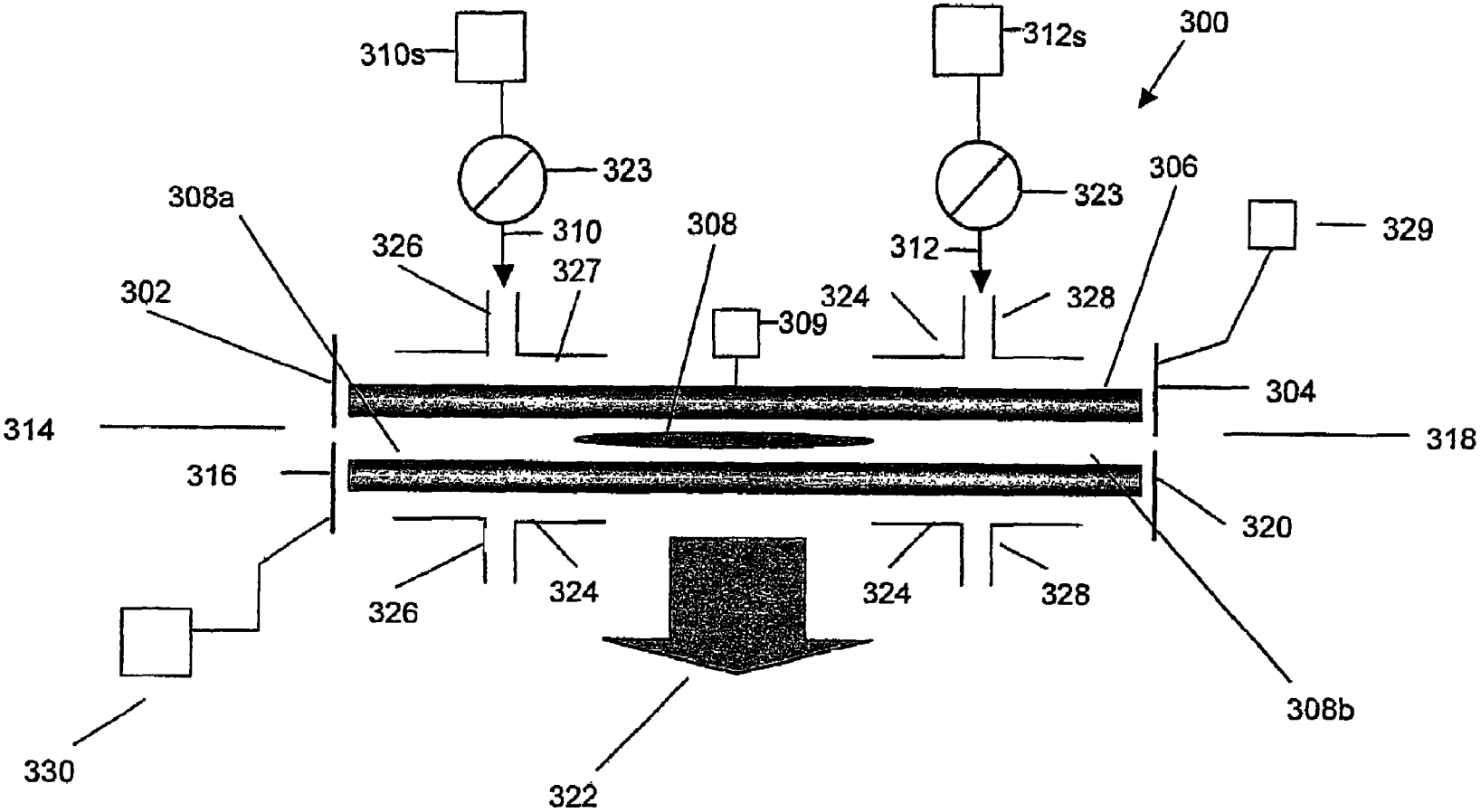
FIG. 3, in a schematic diagram, illustrates a linear ion trap mass spectrometer in which axial gas flows are provided at points part-way between the end and the mid-point of the linear ion trap mass spectrometer, which axial gas flows are channeled by confining sleeves in accordance with a further embodiment of the invention.

Referring to FIG. 3, there is illustrated in a schematic diagram, a linear ion trap mass spectrometer system 300 in accordance with a third embodiment of the invention. For clarity, the same reference numerals, together with 100 added, are used to designate elements of the linear ion trap mass spectrometer 300 analogous to elements of the linear ion trap mass spectrometer 200 of FIG. 2. For brevity, some of the descriptions of FIGS. 1 and 2 will not be repeated with respect to FIG. 3.

Similar to the linear ion trap mass spectrometer 200 of FIG. 2, the linear ion trap mass spectrometer 300 of FIG. 3 comprises sleeves 324 for improving the gas barriers provided by gas flows 310 and 312; however, unlike the linear ion trap mass spectrometers 100 and 200, in the linear ion trap mass spectrometer 300 the gas flows 310 and 312 are not provided via first and second end apertures 314 and 318 in first and second end plates 316 and 320 respectively. Instead, first gas flow 310 is provided to the rod set 306 via first gas inlet port 326, while second gas flow 312 is provided to the rod set 306 via second gas inlet port 328. First gas inlet port 326 is spaced from the first end 302 of the rod set 306 toward the middle of the rod set 306. Similarly, second gas inlet port 328 is spaced from the second end 304 toward the middle of the rod set 306.

As a result, the first gas flow 310 is provided in two axial directions from first gas inlet port 326. That is, as with linear ion trap mass spectrometers of FIGS. 1 and 2, first gas flow 310 is provided from the first gas inlet port 326 toward the middle of the rod set 306. In addition, first gas flow 310 is also provided in the opposite axial direction (a first gas counterflow) from the first gas inlet port 326 toward first end 302 of the rod set 306. In both cases, the first gas flow 310 within the rod set 306 is channeled to flow in a substantially axial direction by sleeves 324. Similarly, as second gas inlet port 328 is spaced from the second end 304 toward the middle of the rod set 306, the second gas flow 312 proceeds both from the second gas inlet port 328 toward the middle of the rod set 306, and in the opposite axial direction from the second gas inlet port 328 to the second end 304 of the rod set 306 (a second gas counterflow). In both cases, again, the second gas flow is channeled to flow in a substantially axial direction by sleeves 324. First end auxiliary electrode 330 and second end auxiliary electrode 329 can provide suitable voltages to first end plate 316 and second end plate 320 respectively to provide the desired barrier fields.

The configuration of the linear ion trap mass spectrometer 300 of FIG. 3 confines the ions 308 further from the ends 302 and 304 of the rod set 306. This configuration also allows for auxiliary trapping regions to be provided at each end of the rod set 306. Specifically, as shown a first end auxiliary trapping region 308*a* can be provided by providing a suitable barrier field at first end 302. Then, ions will be trapped in trapping region 308*a* between a first gas flow 310 toward the first end 302 and the barrier field provided at end 302. This barrier field may, for example, be provided at first end plate 316, or may alternatively be provided to other electrodes.

Similarly, a second auxiliary trapping region 308*b* can be provided between a suitable barrier field provided at second end 304 of linear ion trap mass spectrometer 300 and second gas inlet port 328. Specifically, a second gas flow 312 from second gas inlet port 328 flows toward second end 304 to trap ions in second end trapping region 308*b*.

The barrier fields provided at ends 302 and 304 of rod set 306 may be DC or AC/RF ("AC/RF" meaning one of AC or RF—in the description that follows, it will be understood by those of skill in the art that where RF fields are used, AC fields outside the RF range may also work). Alternatively, one may be DC while the other is RF. Whether the barrier fields are RF or DC will depend upon the ions to be trapped in the trapping region 308*a* and 308*b*. Specifically, say that only positive ions are to be stored in trapping regions 308*a* and 308*b*, while ions of both polarities are to be stored in the main trapping region between gas inlet ports 326 and 328. Then either RF or positive DC barrier fields may be provided at the ends 302 and 304. Say, for example, that positive ions are to be stored in trapping region 308*a*, and negative ions are to be stored in trapping region 308*b*. To trap these ions, RF barrier fields may be provided at both ends 302 and 304. Alternatively, a positive DC barrier field can be provided at end 302 and a negative DC barrier field provided at end 304. If, on the other hand, the ions being trapped in auxiliary trapping regions 308*a* and 308*b* are both positive and negative, then RF barrier fields must be provided at both ends.

Figure 4:
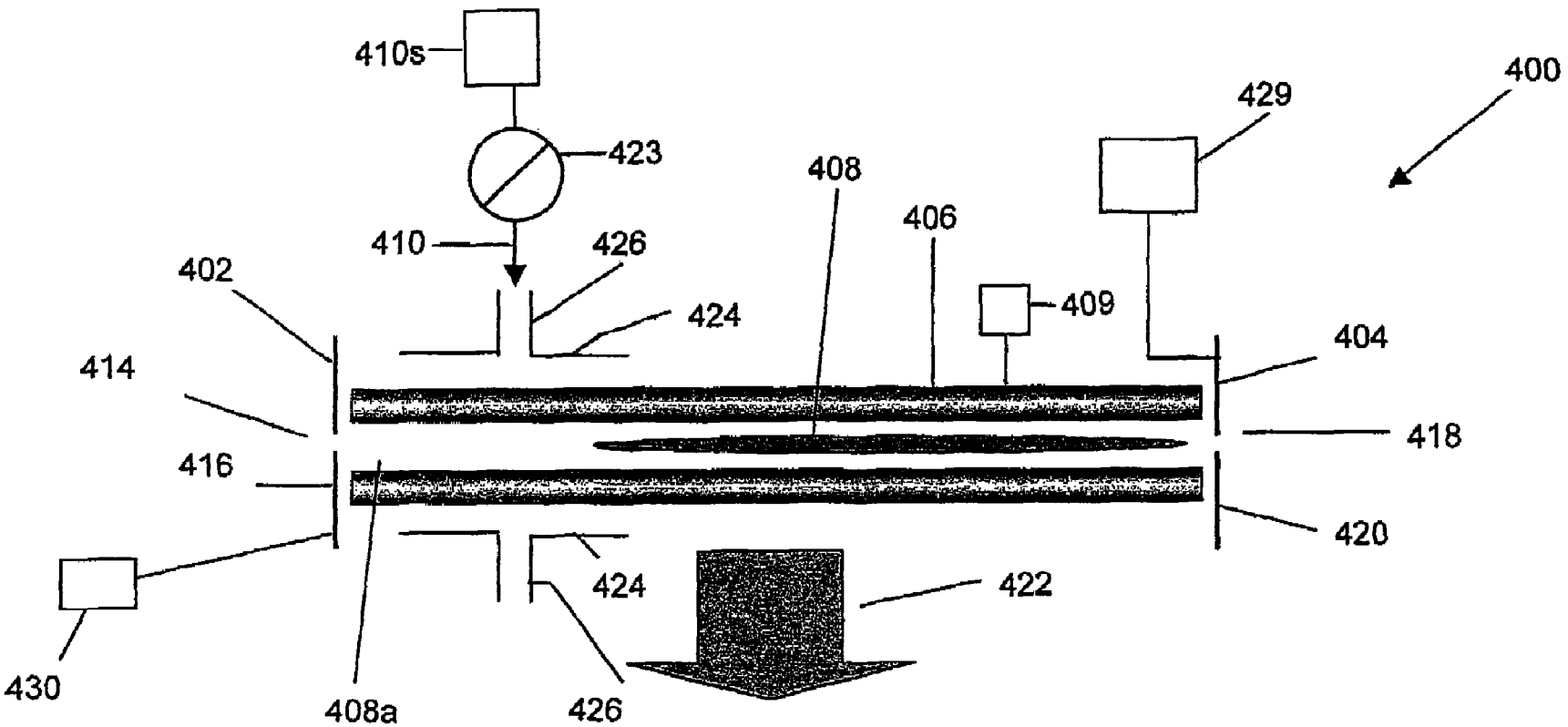
FIG. 4, in a schematic diagram, illustrates a linear ion trap mass spectrometer in which a barrier field is provided at one end of the rod set while axial gas flows are provided to a gas entry point part-way between the other end of the linear ion trap mass spectrometer and the midpoint of the linear ion trap mass spectrometer in accordance with a further embodiment of the invention.

Referring to FIG. 4, there is illustrated in a schematic diagram, a linear ion trap mass spectrometer 400 in accordance with a fourth embodiment of the invention. For clarity, the same reference numerals, together with 100 added, are used to designate elements of the linear ion trap mass spectrometer 400 analogous to elements of the mass spectrometer 300 of FIG. 3. For brevity, the description of FIG. 3 will not be repeated with respect to FIG. 4.

Similar to the linear ion trap mass spectrometer 300, the linear ion trap mass spectrometer 400 comprises a first gas inlet port 426 that is spaced from a first end 402 of the rod set 406 toward the middle of the rod set 406. However, unlike the linear ion trap mass spectrometer system 300 of FIG. 3, the linear ion trap mass spectrometer system 400 of FIG. 4 does not include a second gas inlet port. Consequently, linear ion trap mass spectrometer 400 comprises a main trapping region between gas inlet port 426 and second end 404 for trapping ions 408, together with a first auxiliary trapping region 408*a* between first end 402 and gas inlet port 426.

The leftward ion barrier of the main trapping region for trapping ions 408 is provided by a first gas flow 410 that flows in a first substantially axial direction from the gas inlet port 426 to the second end 404. This leftward barrier impedes ions 408 from escaping from the main trapping region toward first end 402 regardless of whether ions 408 are positive or negative. If ions 408 are both positive and negative, then an RF or AC voltage can be applied to second end plate 420 by second end auxiliary electrode 429 to impede ions 408 from escaping via second end aperture 418 at second end 404. Alternatively, if ions 408 are only of a single polarity, then second end auxiliary electrode 429 can provide either an RF/AC voltage to second end plate 420 or, alternatively, can provide a DC voltage of the same polarity as the ions 408 to effectively trap the ions 408 within the main trapping region of the rod set 406.

In addition to the first gas flow 410 in the first axial direction, a first gas counterflow 410 flows from first gas inlet port 426 toward first end 402. This provides a rightward barrier to the first auxiliary trapping region 408*a* for impeding ions of either polarity from escaping from the auxiliary trapping region in the first axial direction toward the second end 404. The rightward ion barrier of first auxiliary trapping region 408*a* can be provided by a barrier field provided to first end plate 416 by first end auxiliary electrode 430. As discussed above, the voltage provided to the first end plate 416 must be RF/AC if ions of both polarities are to be trapped in first auxiliary trapping region 408*a*. If, on the other hand, only ions of a single polarity are to be trapped in first auxiliary trapping region 408*a*, then first end auxiliary electrode 430 may alternatively provide a DC voltage of the same polarity as the ions to be trapped to the first end plate 416. Of course, even if ions of only a single polarity are to be trapped in the first auxiliary trapping region 408*a*, first end auxiliary electrode 430 may still provide an RF/AC voltage to first end plate 416 to trap these ions.

Figure 5:
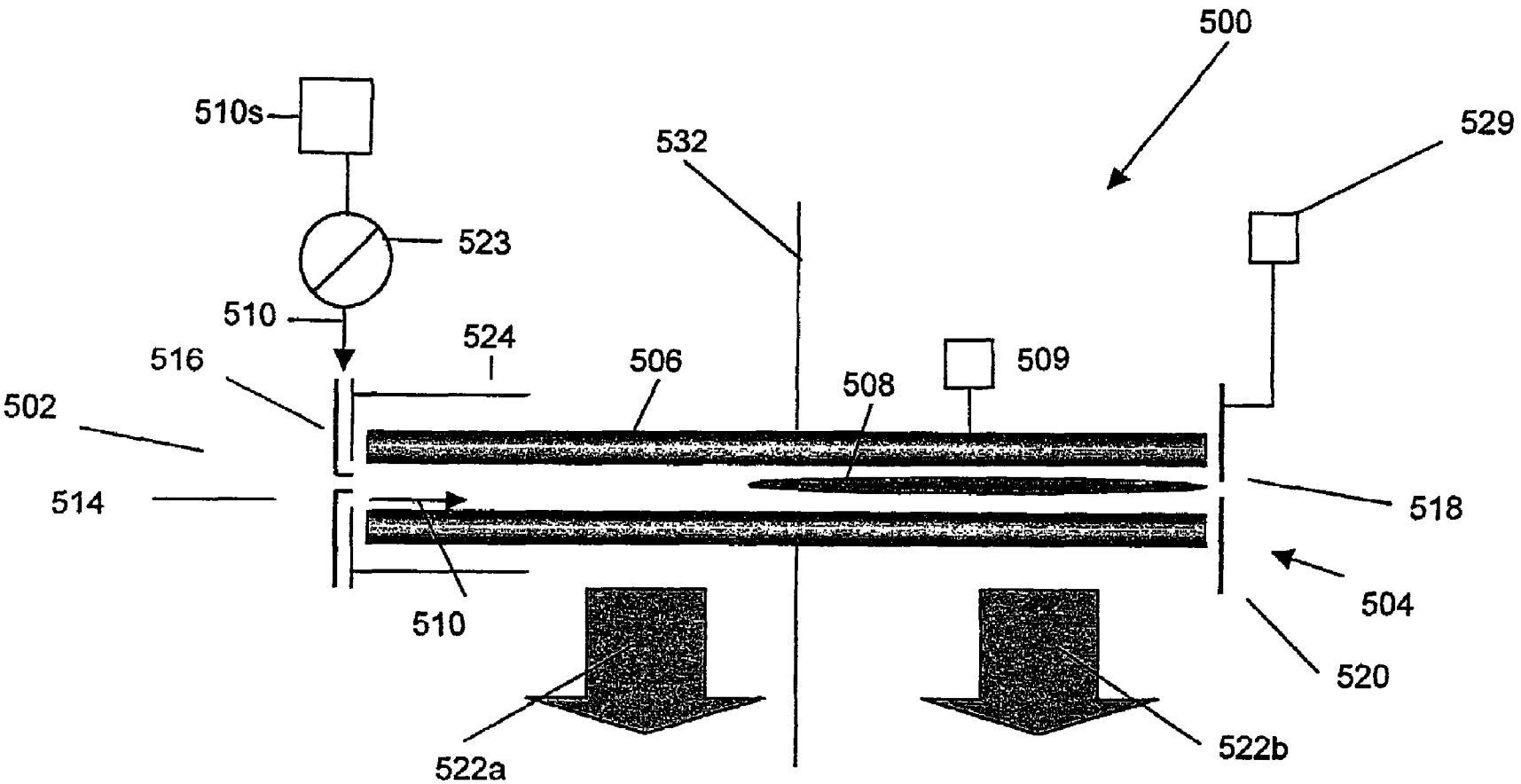
FIG. 5, in a schematic diagram, illustrates a linear ion trap mass spectrometer in which a gas flow is provided at one end while a barrier field is provided at the other end of the linear ion trap mass spectrometer, and differential pumping is provided along the length of the linear ion trap mass spectrometer in accordance with a further embodiment of the invention.

Referring to FIG. 5, there is illustrated in a schematic diagram, a linear ion trap mass spectrometer 500 in accordance with a fifth embodiment of the present invention. For clarity, the same reference numerals, together with 100 added are used to designate elements of the linear ion trap mass spectrometer 500 analogous to elements of the linear ion trap mass spectrometer 400 of FIG. 4. For brevity, the description of FIG. 4 is not repeated with respect to FIG. 5.

The linear ion trap mass spectrometer 500 of FIG. 5 is asymmetrical about a wall 532, located approximately midway between ends 502 and 504. Similar to linear ion trap mass spectrometer 400 of FIG. 4, in the linear ion trap mass spectrometer 500 of FIG. 5 a gas ion barrier is provided toward only one end, a suitable barrier field being provided at the other end.

A first gas flow 510 is provided to a rod set 506 of the linear ion trap mass spectrometer 500 via a first end aperture 514 in a first end plate 516, such that the first gas flow 510 flows in a substantially first axial direction from the first end 502 toward the middle of the rod set 506. A first pumping station 522*a* is provided between the first end 502 and middle 532 of the rod set 506. This first pumping station pumps out most of the first inert gas in the first gas flow 510. However, some of this first inert gas, as well as other gasses, may end up between the first pumping station 522*a* and second end 504. Accordingly, a second pumping station 522*b* is provided toward the second end 504 of the rod set 506 to reduce the gas pressure within the main trapping region of the linear ion trap mass spectrometer 500. Of course, wall 532 need not be located midway between ends 502 and 504, but could instead be located at different points along the length of rod set 506.

Similar to the ion trap mass spectrometer 400 of FIG. 4, the ion trap mass spectrometer 500 of FIG. 5 comprises a main trapping region between first pumping station 522*a* and second end 504. However, ion trap mass spectrometer 500 does not comprise an auxiliary trapping region. That is, the first gas flow 510 from the first end 502 to the first pumping station 522*a* is, in some embodiments, sufficiently strong to impede ions 508 of either polarity from moving past first pumping station 522*a* toward first end 502.

In addition to this first gas flow 510 in the first axial direction, an RF/AC voltage can be applied to second end plate 520 by second end auxiliary electrode 529 to impede ions 508 from escaping via second end aperture 518 at second end 504.

In the embodiments described above, axial-flows are used to provide a barrier for ions of both polarities. In some embodiments, it is advantageous to use axial fields in such embodiments to push ions out at either end of the rod set (alternatively, of course, ions may be radially ejected). Suitable electrodes for providing such axial fields are described, for example in Loboda A., Krutchinsky, A., Loboda O., McNabb J., Spicer, V, Ens, W., and Standing K., "LINAC II Electrode Geometry for Creating an Axial Field in a Multipole Ion Guide", Department of Physics and Astronomy, University of Manitoba, Winnipeg, Canada Eur. J. Mass Spectrom, 6, 531-563, (2000); available at (http://www.impub.co.uk/abs/EMS06_0531.html) (hereinafter "the Loboda reference"). An ion trap mass spectrometer system 600 incorporating electrodes similar to those described in the above reference is described below. This or other suitable method of introducing axial field to RF-ion guide can be employed. A variety of such methods have been described in U.S. Pat. No. 6,111,250.

Figure 6:
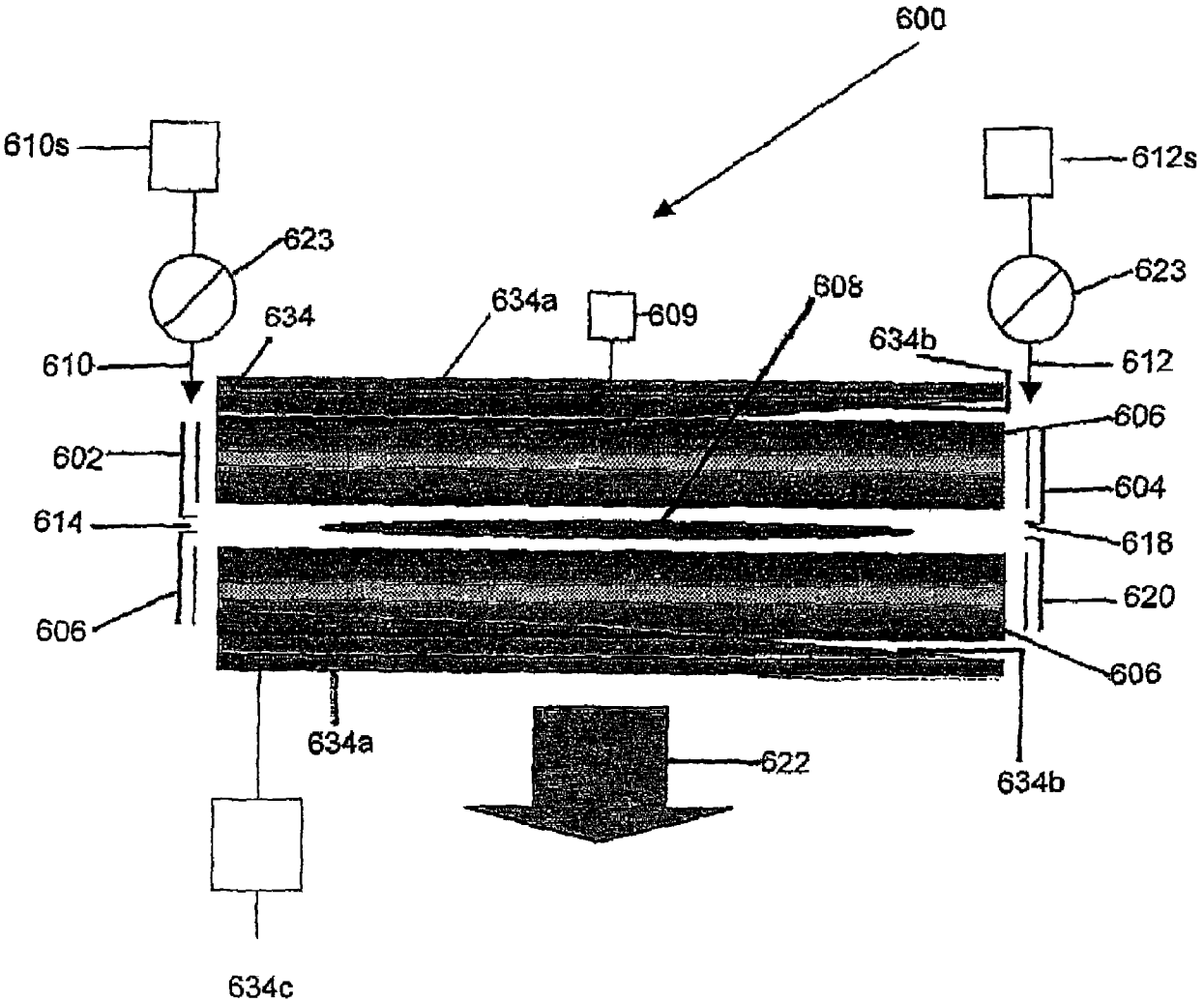
FIG. 6, in a schematic diagram, illustrates a linear ion trap mass spectrometer in which oppositely oriented gas flows are provided at each end of the linear ion trap, and in which electrodes are provided to produce axial fields along the length of the mass spectrometer in accordance with a further embodiment of the invention.

Referring to FIG. 6, there is illustrated in a schematic diagram, a linear ion trap mass spectrometer 600 in accordance with the sixth embodiment of the present invention. For clarity, the same reference numerals, together with 500 added, are used to designate elements of the linear ion trap mass spectrometer 600 analogous to elements of the linear ion trap mass spectrometer 100 of FIG. 1. For brevity, the description of FIG. 1 is not repeated with respect to FIG. 6.

In addition to the elements of a linear ion trap mass spectrometer 100 of FIG. 1, the linear ion trap mass spectrometer 600 of FIG. 6 comprises electrodes 634 having a T-shaped cross-section. The electrode arrangement shown can be used to produce a small axial field in a multipole ion guide without significantly limiting the m/z window of the ion guide, while the electrodes 634 have a T-shaped cross-section. This particular shape was selected only because of the resulting rigidity of the electrodes 634 and for convenience; other electrodes having a different shape might also be employed.

The potential on the axis of an ion guide $U_\alpha$ is determined by a linear combination of $U_L$ (the DC potential) and $U_b$, which is the DC potential bias of the main rod set, according to the following equation:

$$U_\alpha(z)=\alpha(z)U_b+\beta(z)U_L \quad (1)$$

As described in the Loboda reference, the parameters $\alpha$ and $\beta$ in the equation depend on the geometry of both the main rods and the extra electrodes, and thus a longitudinal variation in the shape or position of the electrodes can lead to a variation of the electric potential along the z-axis. The z-gradient of this potential variation determines the axial electric field.

Figure 7:
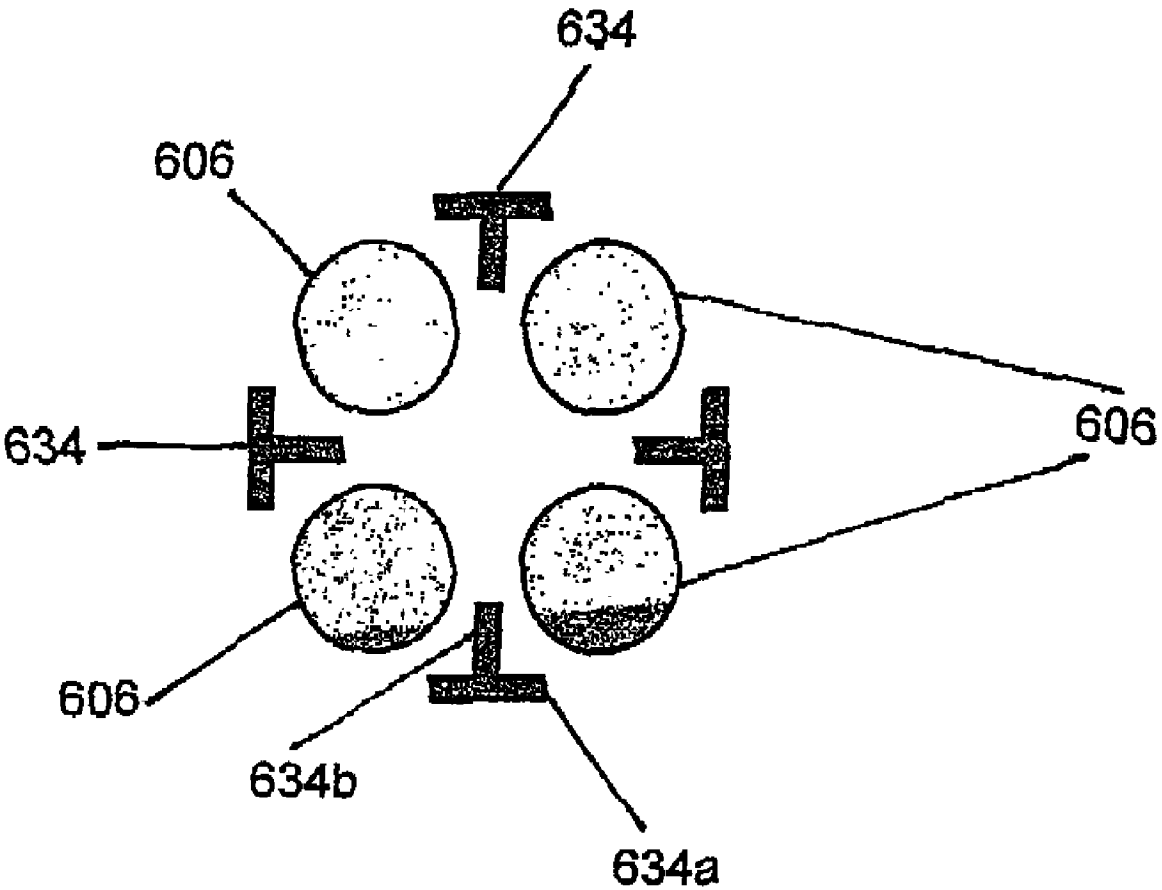
FIG. 7, in a sectional view, illustrates the rods and electrodes of the linear ion trap mass spectrometer of FIG. 6.
Figure 8:
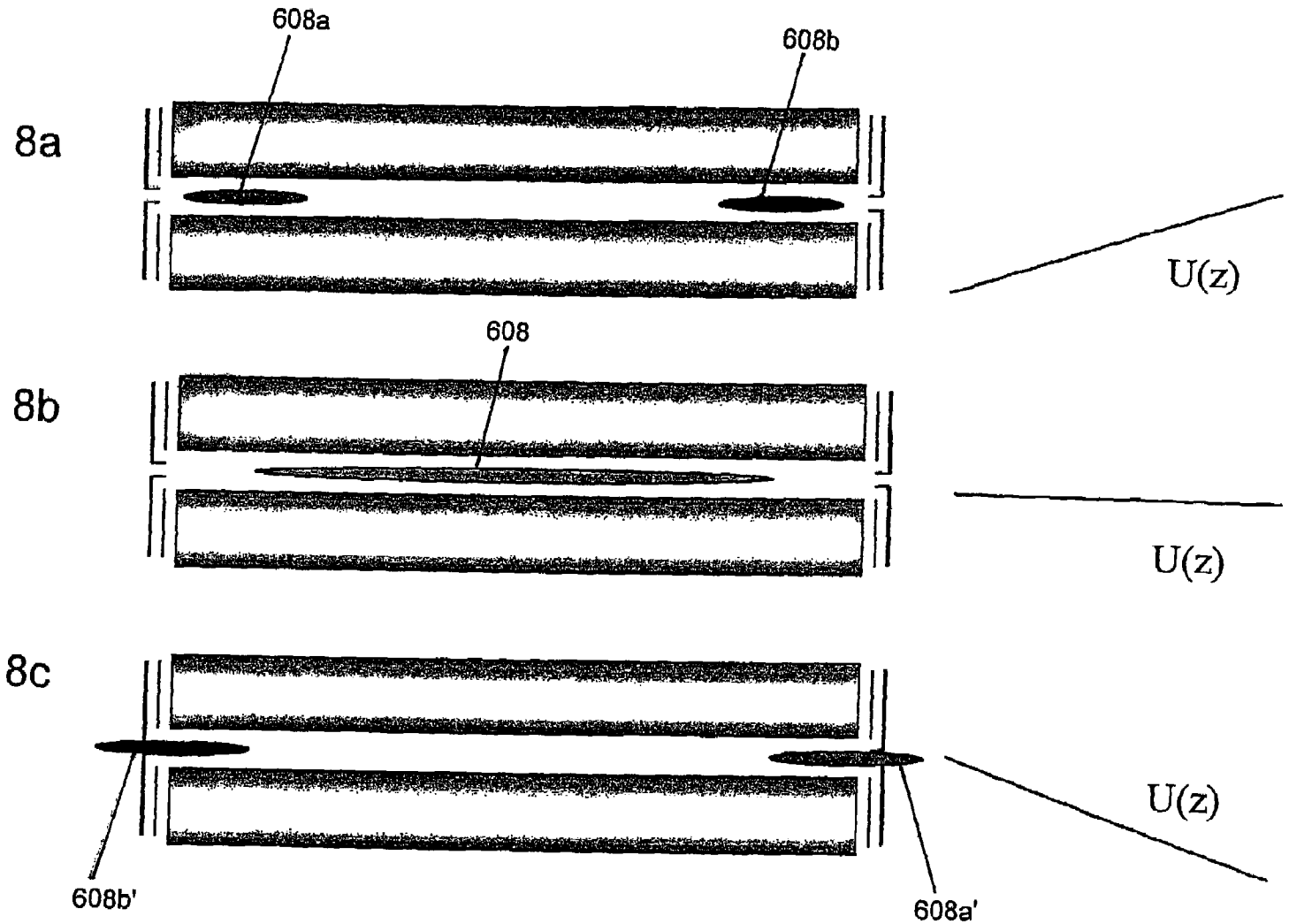
FIGS. 8*a*, 8*b* and 8*c*, in schematic diagrams, illustrate different stages of operation of the linear ion trap mass spectrometer of FIG. 6, together with different axial fields applied during these different stages of operation, in accordance with further aspects of this embodiment of the invention.

Referring to FIG. 7, a cross-section of rod set 606 and electrodes 634 of ion trap mass spectrometer system 600 is shown. As shown in FIG. 7, each electrode 634 comprises a base 634*a* and a stem 634*b*, and is powered by an auxiliary voltage provided by an auxiliary voltage power supply 634*c*. As shown in FIG. 6, the cross-section of the electrodes 634 is varied in the longitudinal direction by changing the dimension of the stem 634*b*.

As described in the Loboda reference and in U.S. Pat. No. 6,111,250, the variation of the axial field can be provided by varying the dimension of the stem of the electrodes along the longitudinal direction. Alternatively, in some embodiments the main rod set can be used to create a suitable axial field. This can be done by changing the cross-sectional area of the rod set along its length and then by applying an additional voltage to one of the pairs of rods to control axial field strength. U.S. Pat. No. 6,110,250, for example, describes different ways of providing a suitable axial field without using additional electrodes. In that patent, FIGS. 3 to 5 illustrate tapered rods and FIGS. 6 to 9 illustrate tilted rods. In both of these cases, the main rod set with the axially varied profile can provide a suitable axial field. No auxiliary electrodes are required. Also, as illustrated in FIGS. 27 and 28 of this patent, rods with resistive coatings, or that are segmented, may also be used to generate suitable axial fields without additional electrodes being required.

Referring back to FIG. 6, the stems 634*b* of the electrodes 634 diminish non-linearly from the first end 602 to the second end 604 to provide the desired axial field as described above. The actual operation of these electrodes in combination with the gas barrier fields is described with reference to FIGS. 8*a*, 8*b* and 8*c* below.

Referring to FIG. 8*a*, the linear ion trap mass spectrometer system 600 of FIG. 6 is illustrated with gas flows 610 (shown in FIG. 6) and 612 being provided at first end 602 and second end 604 respectively to axially confine the ions. In addition, as shown on the right side of the ion trap mass spectrometer system 600, an axial potential U(z) is provided which is positive at end 604 (shown in FIG. 6) of mass spectrometer system 600 and negative at end 602. As a result, positive ions 608*a* are attracted to end 602, while negative ions 608*b* are attracted to second end 604 of the mass spectrometer system. By this means both positive and negative ions can be trapped in the rod set 606, but in disjoint ion clouds to impede reactions between these two groups of ions from taking place.

Referring to FIG. 8*b*, the axial field is turned off, U(z)=0, such that the positive and negative ions are now free to react with one another in ion cloud 608. Ions 608 remain confined in rod set 606 by gas flows 610 and 612 at first end 602 and second end 604 of the rod set 606.

Referring to FIG. 8*c*, gas flows 610 and 612 are turned off or at least diminished. Alternatively, the axial field U(z) can be strengthened sufficiently to overcome gas flows 610 and 612. At the same time, an axial field U(z)—shown to the right of mass spectrometer system 600 of FIG. 8*c*—is provided that is opposite to that previously provided in relation to FIG. 8*a*. That is, the axial field U(z) is positive at first end 602 of the rod set 606 and is negative at second end 604 of the rod set 606 such that negative ions 608*b*' are axially ejected from first end 602 of the rod 606, while positive ions 608*a*' are axially ejected from second end 604 of rod set 606. Please note, of course, that ion cloud 608*b*' of FIG. 8*c* need not be the same as ion cloud 608*b* of FIG. 8*a* nor need ion cloud 608*a*' of FIG. 8*c* be the same as ion cloud 608*a* of FIG. 8*a*, due to the ion reactions that took place at the stage illustrated in FIG. 8*b*.

OPERATIONAL EXAMPLES

The above-described methods and apparatuses can be used to facilitate ion/ion reactions as described, for example, in the following three papers: (1) Syka, John E. P., Coon, Joshua J., Schroeder, Melanie J., Shabanowitz, Jeffrey and Hunt, Donald F.—"Peptide and Protein Sequence Analysis by Electron Transfer Dissociation Mass Spectrometry"—*The National Academy of Sciences of the U.S.A.* (2004), Vol. 101, No. 26, pp 9528-9533 (hereinafter "the Syka reference"); (2) Xia, Y., Liang, A., McLuckey Scott A.—"Pulsed Dual Electrospray Ionization for Ion/Ion Reactions"—*American Society for Mass Spectrometry* (2005) 16, pp 1750-1756 (hereinafter "the Xia reference"); (3) McLuckey, Scott A., Reid, Gavin E., and Wells, J. Mitchell—"Ion Parking during Ion/Ion Reactions in Electrodynamic Ion Traps"—*Analytical Chemistry*, Vol. 74, No. 2, Jan. 15, 2002 (hereinafter "the McLuckey reference").

The above-listed Syka and McLuckey references describe set-ups with linear ion traps used for ion/ion reactions. The Xia reference describes the benefit of ion parking, which is a technique that can be employed in a linear ion trap. Specifically, several classes of reactions can be employed to gain additional information about samples under consideration. These classes of reactions, which are described below, are facilitated by occurring in a trapping region in which ions of opposite polarity can be trapped.

Charge Reduction

In this class of reaction, multiply-charged ions of interest are initially trapped in a trapping region as described above, which can be used to trap ions of opposite polarity. Then, ions of a polarity opposite to the polarity of the multiply-charged ions of interest are added to reduce the charge state of the multiply-charged ions of interest. Adding such ions of opposite polarity can help in obtaining cleaner spectra and avoiding interferences.

Ion Parking

Say, for example, that multiply-charged analyte ions are stored in a trapping region of a linear ion trap as described above. The linear ion trap is configured such that the trapping region can simultaneously trap ions of opposite polarity. The multiply-charged analyte ions contain ions of a mass to charge ratio of interest together with other ions that are not of interest. An excitation field is superimposed in a linear ion trap to "warm up" the ions with mass to charge ratios of interest. The application of this excitation field inhibits the ion/ion reaction rate for the warmed-up ions of interest. Then, ions of opposite polarity are added to the multiply-charged analyte ions stored in the trap. These ions of opposite polarity will react to a much lesser extent with the warmed up ions of interest as compared to other analyte ions. The bases for this reaction rate inhibition are (1) an increase in a relative velocity of the ion/ion reaction pair, which can reduce the cross section for ion/ion capture; and, (2) reducing the time during which the positively and negatively charged ion clouds, containing the ion of interest, physically overlap. As a result of the charge reduction reaction rate being much lower for the warmed-up ions of interest, most of the analyte ions will eventually be grouped together in the mass to charge ratio targeted by the excitation fields. This can greatly enhance the signal of the ions of interest of multiply-charged analyte ions that typically have a broad distribution of charge states, which can dilute the intensity of individual peaks in the mass spectra.

Charge Transfer Dissociation

In this class of reaction, ions of opposite polarity react to fragment the analyte ions, thereby facilitating structural elucidation of the analyte ions.

Charge Refersal Reaction

According to this class of reaction, the charge of the analyte ions is altered to the opposite polarity as a result of ion/ion reactions. This can facilitate structural elucidation since ion fragmentation depends on the initial charge state of the ions. That is, the ions of interest can be initially fragmented "as is" using collisional-induced dissociation (CID) and MS/MS spectra can be recorded under these conditions. Then, another group of ions of the same kind can be first subjected to charge reversal reactions followed by CID fragmentation resulting in an alternative MS/MS Spectrum. These two MS/MS Spectra may have complementary information about the structure of the ion under investigation. Additional methods of ion manipulation that can be employed in accordance with aspects of the invention are described in, for example: McLuckey S. A., Stephenson J. L. Jr.—"Ion/ion chemistry of high-mass multiply charged ions"—*Mass Spectrom Rev.* 1998 November-December; 17(6): (369-407).

Other variations and modifications of the invention are possible. For example, instead of axially ejecting the ions, selected ions may, of course, be radially ejected through cut outs in the rods to detectors. In addition, while the forgoing description has referred to rod sets and mass spectrometers, it will be appreciated by those with skill in the art that the present invention may be employed with ion guides other than rod sets, such as, for example, helixes and ring-guides. Further, linear ion traps that are not mass spectrometers may also be employed. All such modifications or variations are believed to be within the sphere and scope of the invention as defined by the claims appended hereto.

The invention claimed is:

1. A method of operating a linear ion trap having an ion guide, the ion guide having a first end and a second end, the method comprising:

a) providing a first group of ions within the ion guide;

b) providing a second group of ions within the ion guide, the second group of ions being opposite in polarity to the first group of ions;

c) providing an RF drive voltage to the ion guide to radially confine the first group of ions and the second group of ions in the ion guide;

d) providing a gas flow of an inert gas in a first axial direction away from the first end of the ion guide and toward a middle of the ion guide to repel both the first group of ions and the second group of ions from the first end of the ion guide; and, e) providing a trapping region barrier for repelling both the first group of ions and the second group of ions away from the second end of the ion guide;

wherein the gas flow in the first axial direction and the trapping region barrier together define a main trapping region for trapping both the first group of ions and the second group of ions.

2. The method of claim 1 wherein the trapping region barrier is provided by a second gas flow of a second inert gas, and step d) comprises providing the second gas flow in a second axial direction away from the second end of the ion guide and toward the middle of the ion guide to repel both the first group of ions and the second group of ions from the second end of the ion guide.

3. The method as defined in claim 2 wherein the step of providing the second gas flow comprises providing the second gas flow into the ion guide at a second gas inlet port wherein the second gas inlet port is spaced from the second end toward the middle of the ion guide.

4. The method as defined in claim 3 further comprising providing a second end barrier for repelling at least one of the first group of ions and the second group of ions away from the second end of the ion guide; and, providing a second gas counterflow in the first axial direction from the gas inlet port to the second end to define a second end auxiliary trapping region between the gas inlet port and the second end barrier.

5. The method as defined in claim 4 wherein the second inert gas is the same gas as the inert gas.

6. The method of claim 1 wherein the trapping region barrier comprises a second end auxiliary AC/RF voltage, and step d) comprises providing the second end auxiliary AC/RF voltage to the second end of the ion guide, the second end auxiliary AC/RF voltage being one of an AC voltage and an RF voltage.

7. The method as defined in claim 1 wherein step d) comprises providing the gas flow into the ion guide at the first end in the first axial direction.

8. The method as defined in claim 7 wherein step d) further comprises pumping the inert gas out of the ion guide at a pumping location spaced from the first end toward the middle of the ion guide to provide the gas flow in the first axial direction.

9. The method as defined in claim 1 wherein step d) comprises providing the gas flow into the ion guide at a gas inlet port wherein the gas inlet port is spaced from the first end toward the middle of the ion guide.

10. The method as defined in claim 9 further comprising providing a first end barrier for repelling at least one of the first group of ions and the second group of ions away from the first end of the ion guide; and, providing a gas counterflow in the second axial direction from the gas inlet port to the first end to define a first end auxiliary trapping region between the gas inlet port and the first end barrier.

11. The method as defined in claim 10 wherein the first end barrier is provided by a first end auxiliary voltage.

12. The method as defined in claim 11 wherein the first end auxiliary voltage is DC such that the first end auxiliary trapping region is operable to trap only ions of a single polarity.

13. The method as defined in claim 11 wherein the first end auxiliary voltage is AC/RF such that the first end barrier is operable to repel both the first group of ions and the second group of ions away from the first end of the ion guide, and the auxiliary trapping region is operable to concurrently trap ions of opposite polarity, the first end auxiliary AC/RF voltage being one of an AC voltage and an RF voltage.

14. The method as defined in claim 1 further comprising pumping the inert gas out of the ion guide at a first pumping location spaced from the first end toward the middle of the ion guide to provide the gas flow in the first axial direction; and pumping a residual amount of the inert gas out of the ion guide at a second pumping location spaced from the first pumping location toward the second end of the ion guide to reduce gas pressure within the main trapping region.

15. The method of claim 1 further comprising timing steps d) and e) to facilitate ion reactions between the first group of ions and the second group of ions to create a group of product ions; and, after steps d) and e), f) reducing the gas flow to facilitate transmission of the product ions via the first end of the ion guide.

16. The method of claim 1 further comprising timing steps d) and e) to facilitate ion reactions between the first group of ions and the second group of ions to create a group of product ions; and, after steps d) and e), f) providing an axial field to push the product ions past the gas flow for transmission via the first end of the ion guide.

17. The method of claim 16 wherein step f) further comprises reducing the gas flow to facilitate transmission of the product ions via the first end of the ion guide.

18. The method of claim 16 wherein step f) further comprises, during steps d) and e), i) orienting the axial field to separate the first group of ions and the second group of ions, and then ii) adjusting the axial field to facilitate ion reactions between the first group of ions and the second group of ions to create the group of product ions.

19. A linear ion trap comprising:

an ion guide, the ion guide having a first end and a second end;

an RF drive voltage power supply connected to the ion guide for providing an RF drive voltage to the ion guide to radially confine ions of both polarities within the ion guide;

a first gas source for providing a first gas flow of an inert gas within the ion guide in a first axial direction away from the first end of the ion guide and toward a middle of the ion guide, the first gas flow having sufficient density and velocity to repel the ions of both polarities away from the first end and toward the second end;

a trapping region barrier at the second end for repelling ions of both polarities away from the second end of the ion guide;

wherein the gas flow in the first axial direction and the trapping region barrier together define a main trapping region for trapping ions of both polarities.

20. The linear ion trap of claim 19 further comprising a second gas source for providing a second gas flow of a second inert gas to provide the trapping region barrier, the second gas flow being in a second axial direction away from the second end of the ion guide and toward the middle of the ion guide and having sufficient density and velocity to repel ions of both polarities from the second end of the ion guide.

21. The linear ion trap of claim 20 wherein the second gas source comprises a second gas inlet port for providing the gas flow into the ion guide, wherein the second gas inlet port is spaced from the second end toward the middle of the ion guide.

22. The linear ion trap of claim 21 further comprising an auxiliary trapping region barrier at the second end for repelling ions away from the second end of the ion guide, wherein the auxiliary trapping region barrier comprises a second end member and a second end auxiliary electrode for providing a second end auxiliary AC/RF voltage to the second end member to repel ions from the second end of the ion guide, the second end auxiliary AC/RF voltage being one of an AC voltage and an RF voltage, the second gas inlet port is operable to provide a gas counterflow in a first axial direction from the gas inlet port to the second end to define a second end auxiliary trapping region between the second gas inlet port and the second end barrier, the gas counterflow having sufficient density and velocity to repel ions of both polarities within the second end auxiliary trapping region away from the gas inlet port.

23. The linear ion trap of claim 22 wherein the second inert gas is the same gas as the inert gas.

24. The linear ion trap of claim 22 wherein the first gas source is also the second gas source.

25. The linear ion trap of claim 19 wherein the trapping region barrier comprises a second end member and a second end auxiliary electrode for providing a second end auxiliary AC/RF voltage to the second end member to repel ions of both polarities from the second end of the ion guide.

26. The linear ion trap of claim 19 further comprising a pump for pumping the inert gas out of the ion guide at a pumping location spaced from the first end toward the middle of the ion guide to direct the gas flow in the first axial direction.

27. The linear ion trap of claim 26 further comprising a second pump for pumping a residual amount of gas out of the ion guide at a second pumping location spaced from the first pumping location toward the second end of the ion guide to direct the gas flow in the first axial direction.

28. The linear ion trap of claim 19 wherein the first gas source comprises a gas inlet port for providing the gas flow into the ion guide, wherein the gas inlet port is spaced from the first end toward the middle of the ion guide.

29. The linear ion trap of claim 28 further comprising an auxiliary trapping region barrier at the first end for repelling ions away from the first end of the ion guide, wherein the auxiliary trapping region barrier comprises a first end member and a first end auxiliary electrode for providing a first end auxiliary AC/RF voltage to the first end member to repel ions from the first end of the ion guide, the first end auxiliary AC/RF voltage being one of an AC voltage and an RF voltage, and the gas inlet port being operable to provide a gas counterflow in a second axial direction from the gas inlet port to the first end to define a first end auxiliary trapping region between the gas inlet port and the first end barrier, the gas counterflow having sufficient density and velocity to repel ions of both polarities within the first end auxiliary trapping region away from the gas inlet port.

30. The linear ion trap of claim 19 further comprising a gas flow confinement means for surrounding the first gas flow from the first gas source and for channeling the first gas flow in the first axial direction.

31. The linear ion trap as defined in claim 19 wherein the first gas source comprises a gas control valve for controlling a flow rate of the first gas flow.

32. The linear ion trap as defined in claim 19 wherein the ion guide further comprises at least one electrode for providing an axial field along the ion guide; and, an auxiliary voltage power supply connected to the at least one electrode for providing an auxiliary voltage to the at least one electrode to provide the axial field, wherein the auxiliary voltage power supply is operable to vary the auxiliary voltage to vary the axial field.

* * * * *